US010300517B2

(12) United States Patent
Schulte

(10) Patent No.: US 10,300,517 B2
(45) Date of Patent: May 28, 2019

(54) PIPE END STRAIGHTENER

(71) Applicant: WAMACO, LLC, Porter, TX (US)

(72) Inventor: Warren Harold Schulte, Porter, TX (US)

(73) Assignee: WAMACO, LLC, Porter, TX (US)

( * ) Notice: Subject to any disclaimer, the term of this patent is extended or adjusted under 35 U.S.C. 154(b) by 0 days.

(21) Appl. No.: 15/268,672

(22) Filed: Sep. 19, 2016

(65) Prior Publication Data

US 2018/0078983 A1 Mar. 22, 2018

(51) Int. Cl.
*B21D 3/10* (2006.01)
*B21C 51/00* (2006.01)

(52) U.S. Cl.
CPC ..... *B21D 3/10* (2013.01); *B21C 51/00* (2013.01)

(58) Field of Classification Search
CPC .... B21D 3/10; B21D 3/14; B21D 3/16; B21C 51/00
USPC ... 72/11.1, 11.2, 16.2, 16.3, 16.4, 17.3, 18.1
See application file for complete search history.

(56) References Cited

U.S. PATENT DOCUMENTS 4,531,391 A * 7/1985 Engman ..... B21D 3/10 72/19.6
5,253,499 A * 10/1993 Knipp ..... B21D 3/10 29/33 T
2015/0068008 A1* 3/2015 Hill ..... B21D 3/10 29/402.19

* cited by examiner

*Primary Examiner* — Teresa M Ekiert
(74) *Attorney, Agent, or Firm* — Dossey & Jones PLLC; Phillip Black; James P Dossey

(57) ABSTRACT

A method and apparatus for straightening a casing is provided herein. The method can include securing a casing in a pipe end straightener, where the pipe end straightener includes a mounting platform, an analog feedback device, and a hydraulic press. The method can also include measuring one or more characteristics of a bent portion of the casing with the analog feedback device. The method can also include straightening the casing by applying a calculated force to the casing with the hydraulic press.

20 Claims, 4 Drawing Sheets

PIPE END STRAIGHTENER

BACKGROUND

Field

This invention relates to the general field of straightening and bending the ends of pipe. More particularly, this invention relates to the straightening of hooked ends of pipe.

Description of the Related Art

Drill pipe, casing pipe, and tubing pipe have long been integral parts of the oil and gas industry. Drill pipe is durable steel pipe that provides the force to the drill bit, thereby cutting into the rock until it reaches the sought after oil and/or gas deposits. The hole drilled by the drill pipe is then lined with casing pipe, which lines the wellbore, provides structural integrity to the well, and protects the layers of soil and the groundwater from being contaminated with drilling fluids. Tubing is then used to transport the oil and gas from deep in the well to the surface. The structural integrity of each of the drill pipe, casing, and tubing is essential to the overall success of the drilling process.

Long lengths of pipe (e.g., 20-foot or 40-foot segments) often become bent during treatment and/or transportation of the pipe. For example, casing pipe can become "hooked" at one or both ends, making it unusable for further manufacture. Notably, a casing having a hooked end can be unfit for machining of the end of the casing pipe (e.g., threading, beveling, etc.). Hooked ends of casing pipe cause the casing pipe to fall outside of American Petroleum Institute ("API") standards, rendering the pipe unfit for use. The API tolerance for bent or "hooked ends" of a casing pipe is ⅛ inches off of the primary axis of the terminal 5 feet of pipe.

A hooked casing can cause a great deal of delay while resulting in great economic loss to the company bearing the cost of repair or replacement. Current methods used to straighten hooked casing are inadequate and expensive. For example, a "gag straightener" method relies on the judgment of a human operator to determine the angle and extent of a bend in a casing. Because such methods rely on the skill of the human operator, the results are often highly inaccurate, incompletely, and expensive.

Therefore, a need exists for a tubular pipe straightener system that is controlled by a programmable logic controller and is able apply a calculated force to pipe with a high degree of repeatability and accuracy. A further need exists for a programmable logic controller and associated equipment that is easily retrofitted to an existing system to thereby automate the operation thereof. Accordingly, a method and/or apparatus are needed in the industry to straighten, or otherwise manipulate, tubular pipe that is accurate, repeatable, and cost efficient.

SUMMARY

In many industries, especially oilfield premium connection end finishing, which is often the last 2 feet of the pipe, pipe needs to be exactly straight. Any variation or "bend" in the pipe can cause the pipe to become unfit for use. The invention disclosed herein refers to an apparatus and a method for manipulating (e.g., straightening) pipe. As is common in the oil and gas industry, a piece of pipe (e.g., 40-foot piece, 20-foot piece, 10-foot piece, etc.) is referred to as a "pipe" or "joint of pipe", the terms can be used interchangeably. When the joint of pipe becomes bent or "hooked" at one end, the center axis of the joint is no longer straight. As such, the portion of the joint having a bend is referred to herein as the "bent portion" of the joint and the portion of the joint that is straight is referred to herein as the "straight portion" of the joint.

To straighten a hooked joint, the hooked end is fed into the disclosed pipe end straightener, stopped, and stabilized by one or more clamps. The pipe end straightener aligns with the straight segment of the joint along its central axis, or the perfect center. An analog feedback device measures preselected characteristics on the pipe, such as the degree of bend, and transmits the measurements to a program logic control which stores the measurements and makes calculations needed for the correction of the bend. The pipe can then be rotated so that it properly aligns with a hydraulic press. The hydraulic press can apply the proper force and distance to the pipe to correct the bend of the pipe. The pipe can then be measured again by the analog feedback device, and the steps can be repeated as necessary or until the pipe is straightened within the desired parameters.

The method and apparatus disclosed herein can be used to bend or straighten any type of tubular pipe (e.g., drilling pipe, casing pipe, or tubing) known to one of ordinary skill in the art. For convenience, the description provided herein will refer to a single type of pipe, casing pipe (herein "casing" or "casing pipe"), but a reader should understand its broad application to a wide variety of types of tubular pipe.

DETAILED DESCRIPTION

Figure 1:
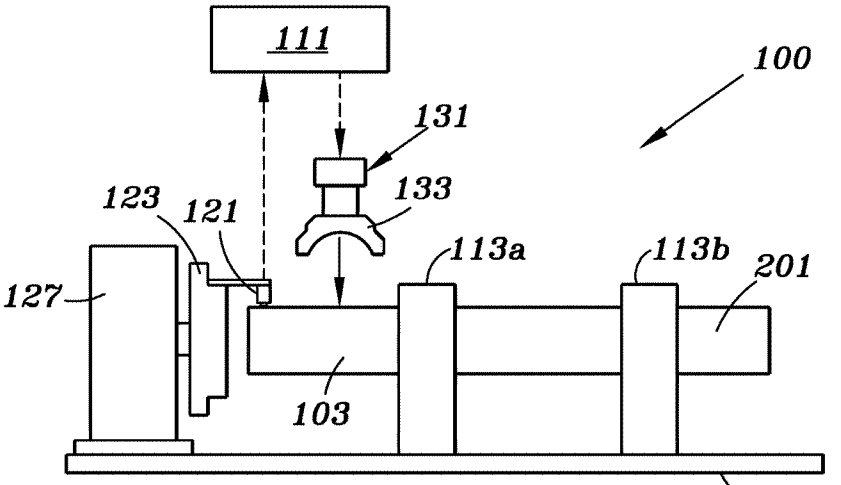
FIG. 1 depicts a side view of the pipe end straightener, according to one or more embodiments described.

A design and method for using a pipe end straightener is provided. FIG. 1 depicts a side view of the pipe end straightener, according to one or more embodiments. The pipe end straightener 100 can be configured to receive and house a casing 201. The pipe end straightener 100 can include one or more headstocks 127, one or more headstock plates 123, one or more analog feedback devices (herein, "AFD") 121, one or more program logic controllers (herein, "PLC") 111, one or more hydraulic presses 131, one or more hydraulic yokes 133, one or more clamps 113, one or more mounting platforms 139, or any combination thereof. A method for using the pipe end straightener 100 to straighten a casing having a hooked end can include loading and securing the casing within the pipe end straightener, determining the angle and severity of bend in the casing, and straightening the casing using the hydraulic press.

Figure 2:
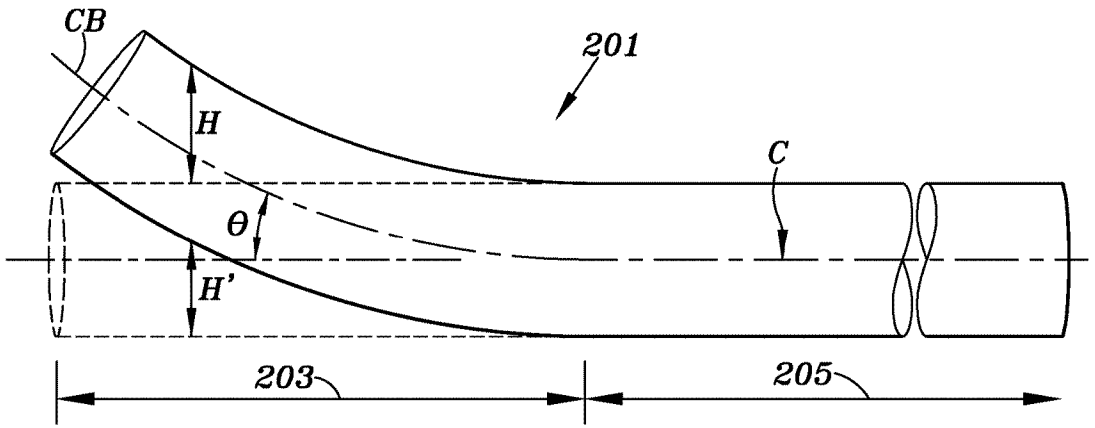
FIG. 2 depicts a view of a casing pipe having a bend along its center axis, according to one or more embodiments described.

As shown in FIG. 2, a casing 201 can have a bend about a first end of the casing (herein referred to as the "bent portion" 203) extending for a distance of the length of the casing 201. Similarly, the same casing 201 can have a straight portion 205 of the casing 201. The straight portion 205 of casing 201 has a center axis C and the bent portion 203 of casing 201 has a bent center axis CB that is not equal to the center axis C of the straight portion 205 of the casing 201. The difference between the center axis C and the bent center axis CB can be referred to as the "radial difference".

There are many possible reasons for the casing 201 to become bent, and it is one benefit of this invention to straighten the bent portion 203 of the casing 201 so that the bent center axis CB is made the same as the center axis C of the straight portion 205. Each casing may be unique, whereby the angle of bend and severity of bend may differ from one casing to the next. As such, the pipe end straightener is able accommodate these variations to provide the desired results.

Referring to FIGS. 1 and 2, the method for straightening the hooked casing 201 can include placing the hooked casing 201 in the pipe end straightener 100 with the bent portion 203 of casing 201 nearest the headstock 127. The headstock 127 can include a predetermined axis point, or central axis point. The central axis point of the headstock 127 can be aligned with the center axis C of the straight portion 205 of the casing 201. The alignment of these two axis points can play an important role by insuring that the casing 201 is properly positioned within the pipe end straightener 100. In one or more embodiments, the headstock can include the one or more headstock plates 123, which can be configured to rotate or spin. In such embodiments, the center of the headstock plate 123 can serve as the central axis point on which the center axis C of the straight portion 205 of the casing 201 should align, such that the straight portion 205 of the casing 201 and the center of the headstock plate 123 have the same center axis.

The casing 201 can then be secured within the pipe end straightener 100 by a securing mechanism, for example, by the one or more clamps 113*a*, 113*b*. The bent portion 203 of the casing 201 can be placed in a position forward of the first clamp 113*a*. In one or more embodiments, the axis alignment can be accomplished by properly positioning the clamps 113*a*, 113*b* so that the center axis C of the straight portion 205 of the casing 201 is aligned along a predetermined center axis of the pipe end straightener 100.

Once properly positioned and secured by the clamps 113*a*, 113*b*, the pipe end straightener 100 can determine the characteristics of the bend in the casing 201, including the degree of the bend and severity of bend in the casing 201. To accomplish this, the AFD 121 can be used. The AFD 121 can come in a variety of forms, according to the needs and embodiment variations in the pipe end straightener 100.

In one or more embodiments, the AFD 121 can be affixed to the headstock plate 123. The headstock plate 123 can then rotate about the center axis C, directing the AFD 121 around the external surface of the casing 201. For example, the headstock plate 123 can direct the AFD 121 around the casing 201 for one or more complete revolutions, each revolution equaling 360 degrees.

As the AFD 121 travels around the outer surface of the casing 201, it can make a plurality of measurements, including measuring the distance of the outer surface of the pipe from the center axis C. A pipe having a hooked end will not have all parts of the circumference are equal distance (same radius value) from the center axis C of the casing 201. Rather, a particular section of the circumference of the pipe will have a greater distance H (herein, "highest point") from the center axis C, while an opposing section of the circumference of the pipe will have a lesser distance H' (herein, "lowest point") from the center axis C. The measurements taken by the AFD 121, including the distance H for the entire circumference of the casing 201, can then be used to calculate the radial difference $\Theta$.

As the AFD 121 takes measurements of the distance of the casing 201 from the center axis C, the measurement of the angle at which these measurements occur may also be taken. For a matter of convenience, the AFD 121 can begin taking measurements of the radial position at the angle of 0 degrees and continue for a full (360 degree) rotation. In one or more embodiments, the AFD 121 can be configured to measure a plurality of characteristics of the casing. For example, the AFD 121 can be configured to measure the thickness of the casing, the composition of the casing, the angle of the bend, the distance of the bend from the end of the casing, the curvature of the bend, and/or any other characteristic of the casing. One or more of these measurements can be used to calculate the characteristics of the force to be applied to the casing to accomplish the desired results (e.g., magnitude, extent, and direction of force needed to straighten a bent portion of a casing). Force can be applied to a casing by a variety of means. As described herein, the calculated force can be applied to a casing by a hydraulic press; however, other means can be used. Moreover, one hydraulic press can be interchangeable with another. For instance, a 4 inch casing may require a first hydraulic press having a first set of capabilities, while a 10 inch casing may require a second hydraulic press having a second set of capabilities.

In the following hypothetical example, a pipe having a 4.0 inch external diameter can have a measurable external radius of 2.0 inches. In this hypothetical example, the following measurements may be made:

TABLE 1

| hypothetical measurements of a hooked casing | | | | | | | | | | | | |
|---|---|---|---|---|---|---|---|---|---|---|---|---|
| | Radial position (degrees) | | | | | | | | | | | |
| | 0° | 45° | 90° | 120° | 150° | 180° | 210° | 240° | 270° | 300° | 330° |
| Distance from center axis C (in inches) | 2.0 | 2.0 | 2.25 | 2.5 | 2.25 | 2.0 | 2.0 | 2.0 | 1.75 | 1.5 | 1.75 |

The hypothetical data indicates that the bent potion of the pipe 203 is at its greatest at 120° at 2.5 inches (where H=0.5 inches) and is at its lowest at 300° at 1.5 inches (where H'=−0.5 inches).

As the AFD 121 takes measurements of the pipe's circumference, it can transmit the collected data to the PLC 111. The PLC 111 can be configured to provide a plurality of functions. For example, the PLC 111 can be configured to store the collected data and/or to calculate the degree and severity of the bend in the casing 201. Once the PLC 111 has made an assessment of the bend in the casing 201, the casing 201 can be repositioned in the pipe end straightener 100.

The highest point H can then be aligned with the hydraulic press 131 so that the hydraulic press 131 can unbend, or reverse the bend, of the casing 201. Aligning the highest point H properly with the hydraulic yoke 133 of the hydraulic press 131 can be accomplished by a plurality of methods. For example, the clamps 113*a*, 113*b* can be loosened and the casing 201 can be rotated by hand. In another example, the pipe end straightener 100 can include a rotation device capable of rotating the casing 201 within the pipe end straightener 100 (not shown). Such a rotation device can be manually or electronically operated, and in such case may be controlled by the AFD 121. The AFD 121 can be configured to transfer information to the rotation device, instructing the rotation device to rotate the pipe according to the AFD 121, as needed.

The rotation of the casing 201 within the pipe end straightener 100 should be performed with great precision, as any error in aligning the casing 201 with the hydraulic press 131 could result in the hydraulic press 131 adding further, unwanted bend to the casing 201. The PLC 111 can instruct the hydraulic press 131 to extend to a calculated distance, thereby applying a calculated force to the casing 201 in such a manner as to straighten the bent portion 203 of the casing 201.

Because each casing is unique (e.g., the characteristics of its bend are unique), the measurements acquired by the AFD 121 can be difference for each casing, and naturally, the calculated force required to straighten each casing, as calculated and determined by the PLC 111, can be different for each casing. The calculated force determined by the PLC 111 can include, for example, the distance, direction, and magnitude of force needed for the hydraulic press to apply to each casing. The hydraulic press, which utilizes a bar coded ram, can work in combination with a precision valve. The result is a movement that is controlled in thousandths of an inch.

Figure 3:
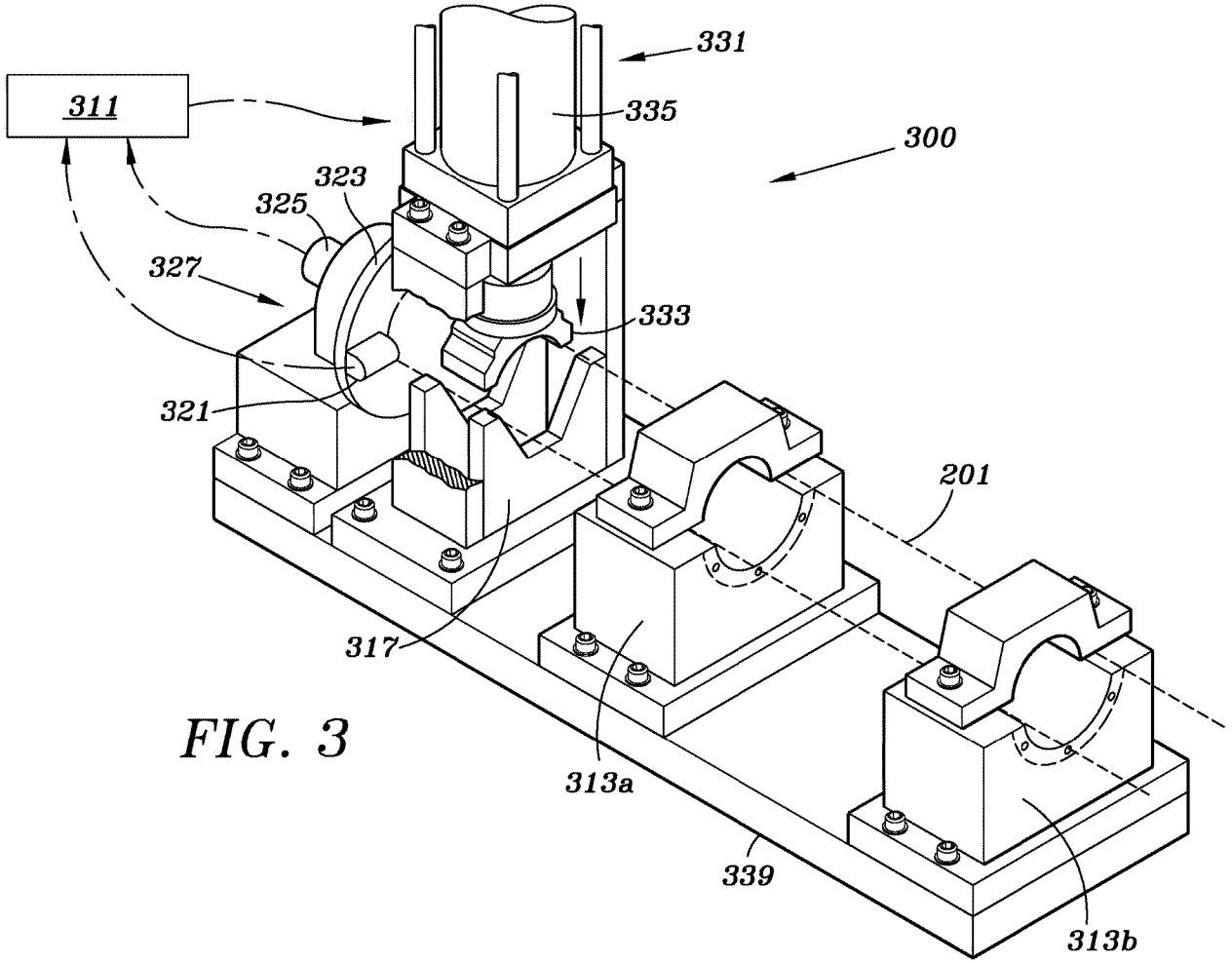
FIG. 3 depicts a perspective view of an alternative embodiment of the pipe end straightener, according to one or more embodiments described.

FIG. 3 depicts a perspective view of an alternative embodiment the pipe end straightener 300. The pipe end straightener 300 can include one or more headstocks 327, one or more headstock plates 323, one or more AFDs 321, one or more PLCs 311, one or more hydraulic presses 331, one or more hydraulic yokes 333, one or more hydraulic cylinders 335, one or more clamps 313*a*, 313*b*, one or more mounting platforms 339, or any combination thereof, each of which may be the same or similar to those described in reference to FIGS. 1 and 2. The pipe end straightener 300 can also include one or more gussets 317, one or more rotary encoders 325, or any combination thereof. The pipe end straightener 300 can also be configured to bend or straighten one or more lengths of casing 201, as discussed and described in reference to FIGS. 1 and 2.

The casing 201 can be disposed within the pipe end straightener 300, having the bent portion of the casing 201 disposed closer to the headstock 327. The one or more clamps 313*a*, 313*b* can secure the casing 201 into place. The clamps 313*a*, 313*b* may vary from one another in design and function, or they may be the same.

In one or more embodiments, the clamp 313*a*, 313*b* can include a top portion and a bottom portion, and each can be sized and configured to secure the casing 201 into place by contacting the outer surface of the casing 201. The bottom portion of the clamp 313*a*, 313*b* may be secured to the mounting platform 339. The means by which the bottom portion of the clamp 313*a*, 313*b* is secured to the mounting platform 339 can include any reasonable means known in the art, including: bolts, screws, nails, glue, magnetic force, clamps, crampons, or any combination thereof. The casing 201 can then be placed in a cradle of the bottom portion of the clamp 313*a*, 313*b*. The cradle can be sized and shaped to fit the casing 201 disposed therein. As such, the top portion and the bottom portion of the clamp 313*a*, 313*b* can be interchangeable. The top portion of the clamp 313*a*, 313*b* can be secured to the bottom portion once the pipe is disposed within the cradle of the bottom portion of the clamp 313*a*, 313*b*. The top portion of the clamp 313*a*, 313*b* can be secured to the bottom portion be any reasonable means known in the art, include any means disclosed herein. In at least one embodiment, the clamps 313*a*, 313*b* can be opened and closed by a hydraulic system, which may be computerized and/or configured to send and receive data and/or instruction from the PLC 311.

Once secured by the clamps 313*a*, 313*b*, the casing 201 can be measured by the AFD 321 to determine the degree and severity of the bend, as discussed herein. The pipe end straightener 300 can also include the one or more rotary encoders 325. The rotary encoder 325 can work in conjunction with the AFD 321 to take measurements of the bend in the casing 201. For example, the AFD 321 can measure the distance of the pipe's radial difference $\Theta$ (as discussed above), while the rotary encoder 325 measures the corresponding radial position. This information can be transmitted to the PLC 311. The casing 201 can then be unclamped and rotated to a position where the radial position of the casing 201 with the greatest radial variation is aligned with the hydraulic press 331.

As in the embodiment shown, the hydraulic press 331 can disposed directly above the casing 201, so, this radial position of the casing 201 will be placed in an "up" position. The casing 201 can then be re-clamped. A computer program can then use the date received to determine the proper amount of distance to push the pipe in the "downward" position.

"Yield value" is the material property defined as the stress at which a material begins to deform plastically. Prior to the yield point, the material will deform elastically and will return to its original shape when the applied stress is removed. Once the "yield value" is passed, some fraction of the deformation will be permanent and non-reversible. This amount of distance must be more than the yield value so that the center axis CB of the casing 201, when the force of the hydraulic press 331 is released, will return to acceptable tolerance value from the center axis C. The distance which the hydraulic press will push the casing 201 down, the "pushdown value", can be calculated using a variety of factors and measurements, including the data collected, pipe dimensions, pipe composition, and/or other mechanical values.

The casing 201 can then be re-measured to verify that the bent portion of the casing 201 has been realigned within the axial tolerance limits relating to the center axis C; the axial tolerance limits usually 0.010" TIR. If the tolerance limits have been exceeded, the new measurements will be acted upon by the controller, and the pipe end straightener 300 can run another cycle of the straightening process. When the tolerance limit is satisfactory, the casing 201 can be unclamped and removed from the pipe end straightener 300.

Figure 4:
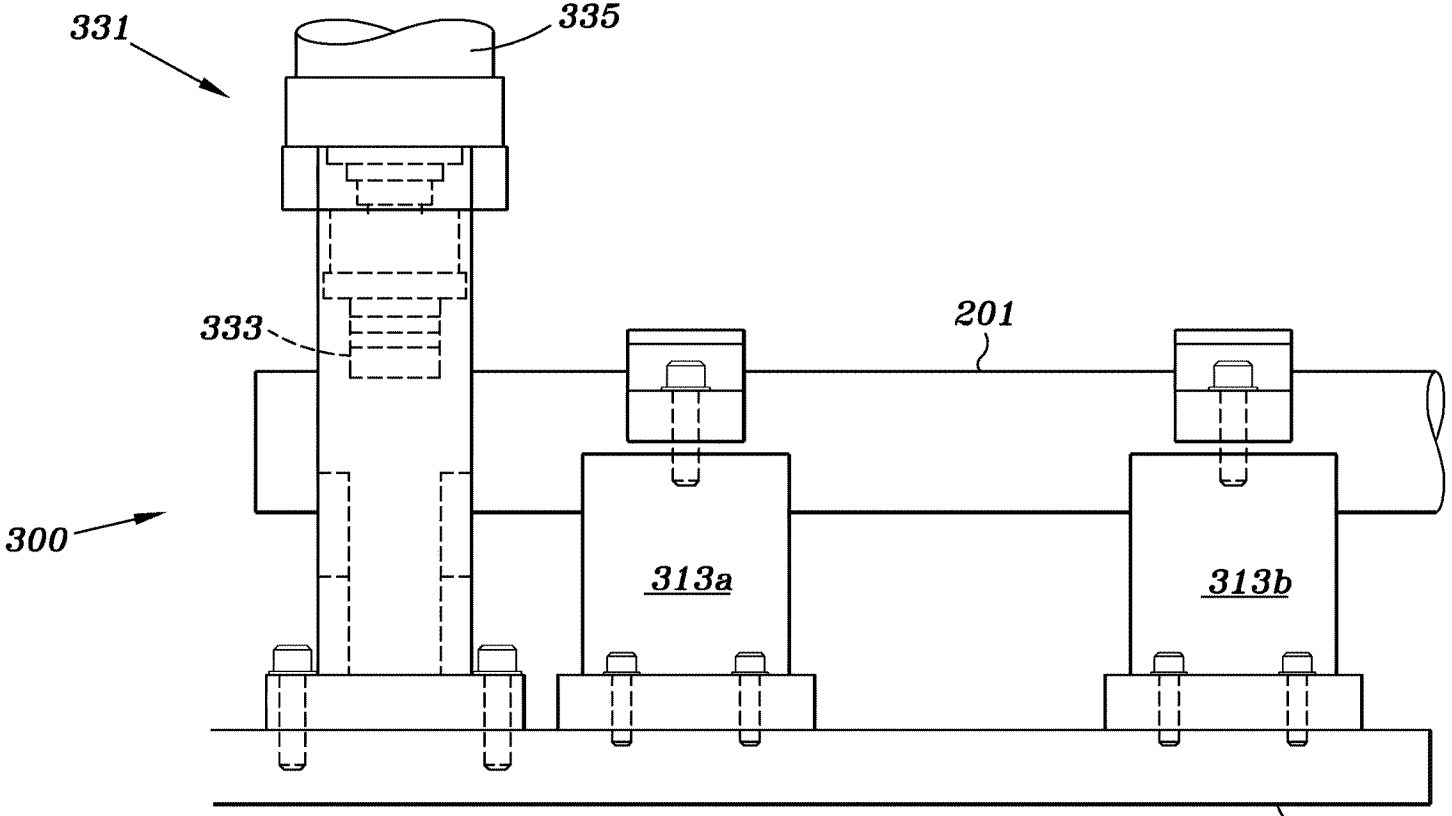
FIG. 4 depicts a cross-sectional side view of the pipe end straightener, according to one or more embodiments described.

FIG. 4 depicts a cross-sectional side view of the pipe end straightener, according to one or more embodiments. The hydraulic press 331 can be mounted to the platform 339 of the pipe end straightener 300. As shown, the hydraulic press 331 can be mounted above the casing 201 such that the cylinder and yoke 333 of the hydraulic press 331 is directed in a downward direction when used to straighten the casing 201, as described above. In this configuration, the hydraulic press 331 can be mounted to the platform 339 via one or more mounting walls, such that the mounting walls are configured to secure the hydraulic press 331 to the platform 330 in such a way so that the hydraulic press 331 is stabilized during operation. In at least one embodiment, the mounting walls can be secured to the mounting platform 339 by means similar to the means used to secure the clamps 313*a*, 313*b* to the mounting platform 339. In one or more alternative embodiments, the hydraulic press 331 can be used without securing the hydraulic press 331 to the mounting platform 339. In such embodiments, however, it is important that the hydraulic press 331 is stabilized such that the hydraulic cylinder and/or hydraulic yoke 333 can properly apply force to the casing 201, as described herein.

Figure 5:
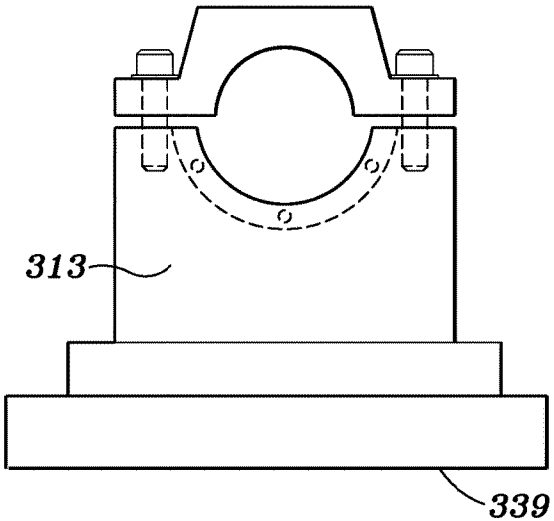
FIG. 5 depicts a cross-sectional front view of the clamp of the pipe end straightener, according to one or more embodiments described.

FIG. 5 depicts a cross-sectional front view of the clamp 313*a*, 313*b* of the pipe end straightener, according to one or more embodiments described. The clamp 313*a*, 313*b* can be positioned and secured to the mounting platform 339 of the pipe end straightener.

Figure 6:
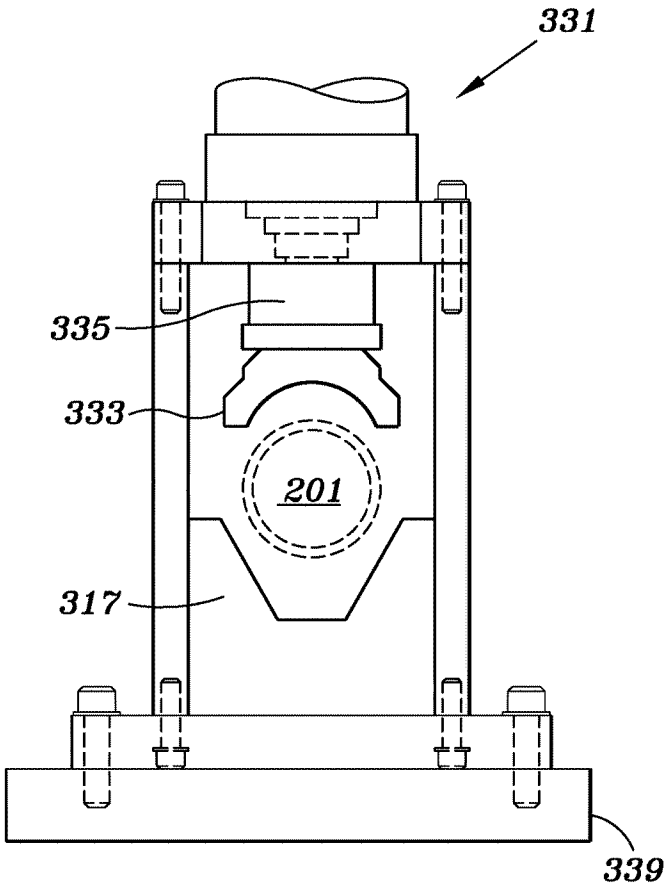
FIG. 6 depicts a cross-sectional front view of the hydraulic press of the pipe end straightener, according to one or more embodiments described.

FIG. 6 depicts a cross-sectional front view of the receiving port of the pipe end straightener, according to one or more embodiments described. A gusset 317 can be positioned below the hydraulic press 331 and can be shaped to receive the casing 201. In most embodiments, the gusset 317 does not come into contact with the casing 201 during operation; rather, the gusset 217 is present for fixture strength and structural support. The hydraulic press 331 can be mounted to the pipe end straightener via one or more support walls, each of which can be secured to the mounting platform 339. The hydraulic press can be configured and/or mounted onto a mounting platform 339 at or near the top of the support walls, and secured thereto.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for straightening a casing, comprising:

securing the casing in a pipe end straightener, wherein the pipe end straightener comprises:

a mounting platform, a headstock and a rotatable headstock plate connected thereto, an analog feedback device mounted directly to the headstock plate, and a hydraulic press, and wherein the casing comprises a bent portion and a straight portion;

establishing a center axis of the straight portion, moving the analog feedback device around the outer surface of the bent portion by rotating the headstock plate, wherein the analog feedback device takes measurements of one or more characteristics of the bent portion in relation to center axis of the straight portion; and straightening the casing by applying a calculated force to the casing with the hydraulic press.

2. The method of claim 1, wherein the center axis of the straight portion of the casing is aligned with a central axis point of the headstock plate.

3. The method of claim 2, wherein the analog feedback device measures the one or more characteristics of such bent portion of the casing by traversing the external circumference of the casing.

4. The method of claim 1, wherein the analog feedback device transmits data to a program logic controller, and wherein the program logic controller calculates the magnitude and direction of force to be applied to the casing by the hydraulic press.

5. The method of claim 4, wherein the program logic controller instructs the hydraulic press to apply the calculated force.

6. The method of claim 1, wherein the headstock plate comprises a central axis point and wherein the central axis point of the headstock plate is aligned with the center axis of the straight portion prior to moving the analog feedback device around the outer surface of the bent portion.

7. The method of claim 1, wherein the bent portion of the casing is disposed about a first end of the casing and wherein the casing is mounted in the pipe end straightener such that the first end of the casing almost contacts the headstock plate.

8. The method of claim 1, wherein securing the casing in a pipe end straightener comprises horizontally positioning the casing within the pipe end straightener and preventing rotational movement of the casing.

9. The method of claim 1, wherein the casing is secured within the pipe end straightener such that the terminal end of the bent portion of the casing is disposed about the headstock plate and wherein the movement of the casing is prevented during the measuring by the analog feedback device.

10. A pipe end straightener, comprising:

a mounting platform configured to secure a casing;

a headstock;

a rotatable headstock plate connected to the headstock;

an analog feedback device mounted directly to the headstock plate and configured to move the analog feedback device around the outer surface of the casing by rotation of the headstock plate, wherein the analog feedback device takes measurements of one or more characteristics of the casing;

a program logic controller configured to analyze the characteristics of the casing and calculate a force to apply to the casing; and a hydraulic press configured to apply the calculated force to the casing.

11. The pipe end straightener of claim 10, further comprising the headstock having a predetermined axis point, wherein the casing comprises a bent portion and a straight portion and wherein the center axis of the straight portion is aligned with the predetermined axis point of the headstock plate.

12. The pipe end straightener of claim 10, wherein the analog feedback device is configured to transmit data to the program logic controller.

13. The pipe end straightener of claim 10, wherein the program logic controller is configured to instruct the hydraulic press to apply the calculated force to the casing.

14. The pipe end straightener of claim 10, wherein one or more clamps are disposed on the mounting platform and configured to prevent the movement of the casing while the casing is being measured and while the casing is being straightened by the hydraulic press.

15. A pipe end straightener, comprising:

a mounting platform configured to receive and secure a casing;

a headstock;

a rotatable headstock plate extending from the headstock;

an analog feedback device mounted directly to the headstock plate and configured to move the analog feedback device around the outer surface of the casing by rotation of the headstock plate, wherein the analog feedback device collects data and wherein the collected data comprises one or more pre-selected characteristics of the casing;

a program logic controller, configured to analyze the collected data to determine the angle of bend in the casing and to calculate such force required to straighten the bend; and a hydraulic press configured to apply the calculated force to the casing.

16. The pipe end straightener of claim 15, wherein the one or more pre-selected characteristics of the casing comprises the angle of bend in the casing.

17. The pipe end straightener of claim 15, further comprising one or more clamps configured to secure the casing within the pipe end straightener.

18. The pipe end straightener of claim 15, wherein the casing comprises a bent portion and a straight portion, and wherein the center axis of the straight portion is aligned with a central axis point of the headstock.

19. The pipe end straightener of claim 15, wherein the casing comprises a bent portion and a straight portion, and wherein the center axis of the straight portion is aligned with a central axis point of the headstock plate.

20. The pipe end straightener of claim 19, wherein the analog feedback device is configured to collect data as the headstock plate rotates about its central axis point.

* * * * *